US011049639B2

(12) United States Patent
Richardson

(10) Patent No.: US 11,049,639 B2
(45) Date of Patent: Jun. 29, 2021

(54) COUPLED COILS WITH LOWER FAR FIELD RADIATION AND HIGHER NOISE IMMUNITY

(71) Applicant: Analog Devices, Inc., Norwood, MA (US)

(72) Inventor: Kenneth G. Richardson, Erie, CO (US)

(73) Assignee: Analog Devices, Inc., Wilmington, MA (US)

( * ) Notice: Subject to any disclaimer, the term of this patent is extended or adjusted under 35 U.S.C. 154(b) by 30 days.

(21) Appl. No.: 15/687,185

(22) Filed: Aug. 25, 2017

(65) Prior Publication Data

US 2018/0233264 A1 Aug. 16, 2018

Related U.S. Application Data

(60) Provisional application No. 62/458,505, filed on Feb. 13, 2017.

(51) Int. Cl.

| | |
|---|---|
| ***H01F 27/28*** | (2006.01) |
| ***H01F 19/04*** | (2006.01) |
| ***H01F 41/04*** | (2006.01) |
| ***H01F 38/14*** | (2006.01) |

(52) U.S. Cl.

CPC ..... *H01F 19/04* (2013.01); *H01F 38/14* (2013.01); *H01F 41/041* (2013.01); *H01F 2038/143* (2013.01)

(58) Field of Classification Search

CPC ..... H01F 19/04; H01F 41/041; H01F 38/14; H01F 2038/143; H01F 5/003; H01F 17/0006; H01F 2017/0073; H01F 2017/0086; H01F 27/2804; H01F 27/323

USPC ..... 336/200, 223, 170, 225, 232, 226

See application file for complete search history.

(56) References Cited

U.S. PATENT DOCUMENTS

| | | | | |
|---|---|---|---|---|
| 5,477,204 | A | 12/1995 | Li | |
| 5,969,590 | A * | 10/1999 | Gutierrez | H01F 27/2804 336/200 |
| 6,466,401 | B1 | 10/2002 | Hong et al. | |
| 6,653,910 | B2 | 11/2003 | Escalera et al. | |

(Continued)

FOREIGN PATENT DOCUMENTS

| | | | |
|---|---|---|---|
| CN | 1842879 | A | 10/2006 |
| CN | 100530458 | C | 8/2009 |

(Continued)

OTHER PUBLICATIONS

Jow et al., Design and optimization of printed spiral coils for efficient transcutaneous inductive power transmission. IEEE Transactions on biomedical circuits and systems. 2007;1(3):193-202.

(Continued)

*Primary Examiner* — Mang Tin Bik Lian

(74) *Attorney, Agent, or Firm* — Wolf, Greenfield & Sacks, P.C.

(57) ABSTRACT

Micro-fabricated coils are described. In some situations, the micro-fabricated coils include interleaved coils. In some situations, pairs of interleaved coils are stacked with respect to each other, separated by an insulating material. In some situations, the interleaved coils have an S-shape. The interleaved coils may be employed in a galvanic isolator.

23 Claims, 14 Drawing Sheets

(56) References Cited

U.S. PATENT DOCUMENTS

| | | | | |
|---|---|---|---|---|
| 7,164,339 | B2 | 1/2007 | Huang | |
| 7,489,220 | B2 | 2/2009 | Baumgartner et al. | |
| 7,952,458 | B2 * | 5/2011 | Ezzeddine | H03H 7/42 257/531 |
| 8,183,971 | B2 | 5/2012 | Le Guillou et al. | |
| 8,258,911 | B2 * | 9/2012 | Fouquet | H01F 19/08 336/170 |
| 8,319,573 | B2 * | 11/2012 | Kanschat | H01F 19/00 333/119 |
| 8,543,190 | B2 | 9/2013 | Wasson et al. | |
| 8,890,519 | B2 | 11/2014 | Klein | |
| 9,196,409 | B2 | 11/2015 | Nazarian | |
| 9,263,180 | B2 * | 2/2016 | Yoon | H01F 17/0006 |
| 9,508,484 | B2 * | 11/2016 | Scholz | H01F 27/2804 |
| 2002/0135236 | A1 * | 9/2002 | Haigh | H01L 23/5223 307/91 |
| 2003/0001709 | A1 | 1/2003 | Visser | |
| 2003/0042571 | A1 * | 3/2003 | Chen | H01F 17/0006 257/531 |
| 2003/0085788 | A1 * | 5/2003 | Yue | H03F 3/45183 336/200 |
| 2006/0290460 | A1 | 12/2006 | Waffenschmidt et al. | |
| 2007/0001796 | A1 * | 1/2007 | Waffenschmidt | H05K 1/165 336/223 |
| 2008/0061631 | A1 * | 3/2008 | Fouquet | H01F 19/08 307/109 |
| 2009/0052214 | A1 * | 2/2009 | Edo | H01F 27/2804 363/123 |
| 2009/0243782 | A1 * | 10/2009 | Fouquet | H01F 19/04 336/200 |
| 2010/0001827 | A1 | 1/2010 | Chen et al. | |
| 2011/0043316 | A1 | 2/2011 | Yang et al. | |
| 2011/0128108 | A1 * | 6/2011 | Kijima | H01L 23/645 336/200 |
| 2011/0148733 | A1 * | 6/2011 | Fahs | H01F 17/0006 343/859 |
| 2013/0169399 | A1 | 7/2013 | Yoo et al. | |
| 2013/0181803 | A1 | 7/2013 | Wyville | |
| 2013/0265131 | A1 | 10/2013 | Yang et al. | |
| 2013/0321116 | A1 * | 12/2013 | Tiemeijer | H01F 27/2804 336/200 |
| 2014/0375411 | A1 * | 12/2014 | Scholz | H01F 27/2804 336/200 |
| 2015/0054350 | A1 * | 2/2015 | Covic | H01F 38/14 307/104 |
| 2015/0206634 | A1 * | 7/2015 | Yan | H01F 17/0006 336/182 |
| 2016/0285317 | A1 * | 9/2016 | Maniktala | H02J 50/70 |

FOREIGN PATENT DOCUMENTS

| | | | |
|---|---|---|---|
| CN | 100580825 | C | 1/2010 |
| CN | 102055248 | A | 5/2011 |
| CN | 105359233 | A | 2/2016 |
| CN | 205595907 | U | 9/2016 |
| EP | 1478045 | A1 | 11/2004 |
| JP | H05-082354 | A | 4/1993 |
| JP | H06-061072 | A | 3/1994 |
| JP | 2004-531089 | A | 10/2004 |
| JP | 2006-147969 | A | 6/2006 |
| JP | 2008-270465 | A | 11/2008 |
| JP | 2011-114203 | A | 6/2011 |
| JP | 2015-518269 | A | 6/2015 |
| JP | 2016-178140 | A | 10/2016 |
| TW | 200839805 | A | 10/2008 |
| WO | WO 2013/141718 | A1 | 0/2000 |
| WO | WO 2005/020254 | A2 | 3/2005 |

OTHER PUBLICATIONS

Pedersen, On the response of interleaved transformer windings to surge voltages. IEEE Transactions on Power Apparatus and Systems. 1963;82(66):349-56.

Yan et al., A novel transformer structure for high power, high frequency converter. Power Electronics Specialists Conference. IEEE, PESC 2007.

* cited by examiner

COUPLED COILS WITH LOWER FAR FIELD RADIATION AND HIGHER NOISE IMMUNITY

CROSS REFERENCE TO RELATED APPLICATIONS

This application claims the benefit under 35 U.S.C. § 119(e) of U.S. Provisional Patent Application Ser. No. 62/458,505, filed on Feb. 13, 2017 and entitled "Coupled Coils with Lower Far Field Radiation and Higher Noise Immunity," which is hereby incorporated herein by reference in its entirety.

FIELD OF THE DISCLOSURE

The present application relates to micro-fabricated coils.

BACKGROUND

Some types of circuits employ coils or windings. For instance, circuits having inductors or transformers may use windings. Examples include galvanic isolators. Micro-fabricated circuits sometimes use micro-fabricated coils.

SUMMARY OF THE DISCLOSURE

Micro-fabricated coils are described. In some situations, the micro-fabricated coils include interleaved coils. In some situations, pairs of interleaved coils are stacked with respect to each other, separated by an insulating material. In some situations, the interleaved coils have an S-shape. The interleaved coils may be employed in a galvanic isolator.

According to one aspect of the present application, a micro-fabricated coil structure is provided. The micro-fabricated coil structure may comprise a substrate, a first pair of interleaved coils on the substrate, a second pair of interleaved coils on the substrate, the second pair of interleaved coils being electromagnetically couplable to the first pair of interleaved coils, and an insulating layer separating the first pair of interleaved coils from the second pair of interleaved coils.

According to another aspect of the present application, an isolator is provided. The isolator may comprise a micro-fabricated transformer comprising a primary coil and a secondary coil, a transmitter, wherein the transmitter is configured to drive the primary coil, and a receiver, wherein the receiver is configured to receive signals from the secondary coil. The primary coil may be a first pair of interleaved coils on a substrate. The secondary coil may be a second pair of interleaved coils on the substrate. The second pair of interleaved coils may be separated from the first pair of interleaved coils by an insulating layer. The second pair of interleaved coils may be electromagnetically couplable to the first pair of interleaved coils.

According to another aspect of the present application, a method of manufacturing a coil structure on a substrate is provided. The method may comprise fabricating a first pair of interleaved coils, forming an insulating layer on the first pair of interleaved coils, and fabricating a second pair of interleaved coils on the insulating layer.

BRIEF DESCRIPTION OF THE DRAWINGS

Various aspects and embodiments of the application will be described with reference to the following figures. It should be appreciated that the figures are not necessarily drawn to scale. Items appearing in multiple figures are indicated by the same reference number in all the figures in which they appear.

DETAILED DESCRIPTION

Figure 1A:
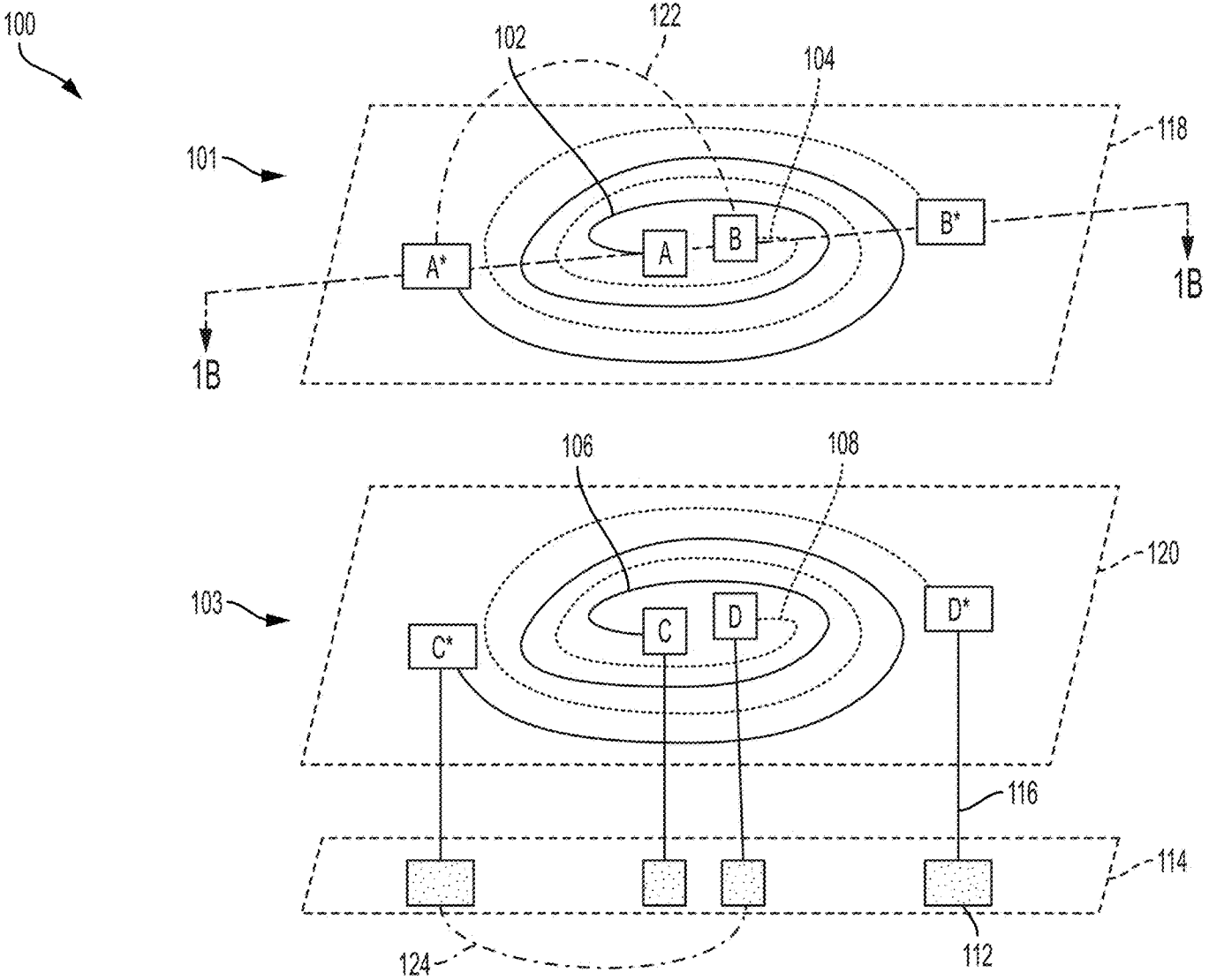
FIG. 1A is a schematic diagram illustrating micro-fabricated stacked interleaved coils, according to some non-limiting embodiments.

Aspects of the present application provide micro-fabricated coils that may be used in galvanic isolator circuits, among other devices. The micro-fabricated coils include interleaved coils. In some situations, pairs of interleaved coils are stacked with respect to each other, separated by an insulating material. In some situations, the interleaved coils have an S-shape. Circuits incorporating the micro-fabricated coils described herein may exhibit improved noise immunity and power consumption, and may be made smaller than circuits incorporating alternative coil structures.

In some embodiments, stacked pairs of micro-fabricated interleaved coils are provided. A pair of interleaved coils may be formed by interleaving two coils. The two coils may be formed from a common metal layer of a micro-fabricated structure. In some embodiments, two pairs of interleaved coils may be positioned in proximity to each other, but separated by an insulating layer to provide galvanic isolation. For example, a first pair of interleaved coils may be vertically separated from a second pair of interleaved coils of a micro-fabricated structure by an insulating layer on a substrate. One pair of interleaved coils may be operated in a first voltage domain and the other pair of interleaved coils may be operated in a second voltage domain. Data and/or power signals may be transferred between the pairs of interleaved coils while maintaining galvanic isolation. The staked pairs of interleaved coils may provide beneficial operating characteristics, including reduced susceptibility to near field disturbances.

In some embodiments, a pair of interleaved coils may be formed by interleaving two "S" coils. An S coil is one in which the winding or trace assumes an S-like configuration, with part of the coil winding in one direction (e.g., clockwise) and part of the same coil winding in the opposite direction (e.g., counter-clockwise). Two planar S coils may be formed from a common metal layer of a micro-fabricated structure. The two S coils may provide four ends (e.g., bond pads serving as contact points). This interleaved structure may be referred to as an "SS" coil. The SS configuration may force the flux induced by the part of the coil winding in one direction to return to the part of the coil winding in the opposite direction to contain the flux that may escape the surface of the coil. Optionally, the SS coils may be connected to provide a center tap, and the center tap can be tied to a supply rail to source or sink displacement currents caused by a common mode voltage potential. The "SS" coil may provide beneficial operating characteristics, including reduced direct far field radiation and, more generally, reduced susceptibility to external fields, including both near field and far field disturbances.

In some embodiments, stacked SS coils are provided. Two SS coils may be separated by an insulating layer to provide galvanic isolation. For example, a first SS coil may be vertically separated from a second SS coil of a micro-fabricated structure by an insulating layer. These stacked SS coils may provide beneficial operating characteristics including reduced susceptibility to both near field and far field electromagnetic disturbances. Also, with suitable additional coupling, power requirements to achieve oscillation may be reduced. For example, stacked SS coils or a single SS coil may be applied to Voltage Control Oscillators (VCO) to achieve lower radiated emission and lower susceptibility to electromagnetic interferences (EMI). In another example, this configuration may also improve the performance of self-excited drive circuits by providing an additional energy path between the driver devices. Circuits incorporating the micro-fabricated coils described herein may consume less power and less chip area to implement than circuits incorporating alternative methods, such as increasing the number of turns of conventional coils or using phase modulation using parallel links.

In some embodiments, micro-fabricated coils may be formed in, partially in, or on a semiconductor substrate. For example, the traces may be patterned from a conductive layer, and may be planar in at least some embodiments. Standard integrated circuit fabrication processing may be used.

The aspects and embodiments described above, as well as additional aspects and embodiments, are described further below. These aspects and/or embodiments may be used individually, all together, or in any combination of two or more, as the application is not limited in this respect.

As described above, an aspect of the present application provides stacked pairs of micro-fabricated interleaved coils. FIG. 1A illustrates an example. Namely, FIG. 1A is a schematic diagram illustrating micro-fabricated stacked interleaved coils 100, according to some non-limiting embodiments. The stacked interleaved coils 100 may include a first (e.g., top) pair of interleaved coils 101 and a second (e.g., bottom) pair of interleaved coils 103 on a substrate 114. The two pairs of interleaved coils 101 and 103 may be separated by an insulating layer 110 (shown in FIG. 1B). The top pair of interleaved coils 101 may include a first coil 102 winding in a direction from terminal A to terminal A*, and a second coil 104 winding in the same direction as coil 102 from terminal B to terminal B*. The terminals of the top pair of interleaved coils may be accessible through bonding pads. The bottom pair of interleaved coils 103 may include a third coil 106 winding in a direction from terminal C to terminal C*, and a fourth coil 108 winding in the same direction as coil 106 from terminal D to terminal D*. The terminals of the bottom pair of interleaved coils may interconnect to a metallization layer 112 in the substrate 114 through vias 116. Traces formed from the metallization layer 112 may connect the terminals of the bottom pair of interleaved coils to bonding pads.

In some embodiments, the top pair of interleaved coils 101 may include a center tap 122. Terminal A* may be electrically connected to terminal B through the center tap 122 such that a mutual inductance can be established between coils 102 and 104. The center tap 122 may be formed by wire bonding pads for terminals A* and B. Similarly, the bottom pair of interleaved coils 103 may include a center tap 124. Terminal C* may be electrically connected to terminal D through the center tap 124. The center tap 124 may be formed by traces of the metallization layer 112 or wire bonding pads for terminals C* and D. The use of such center taps is optional, as alternative embodiments lack the center taps.

Figure 1B:
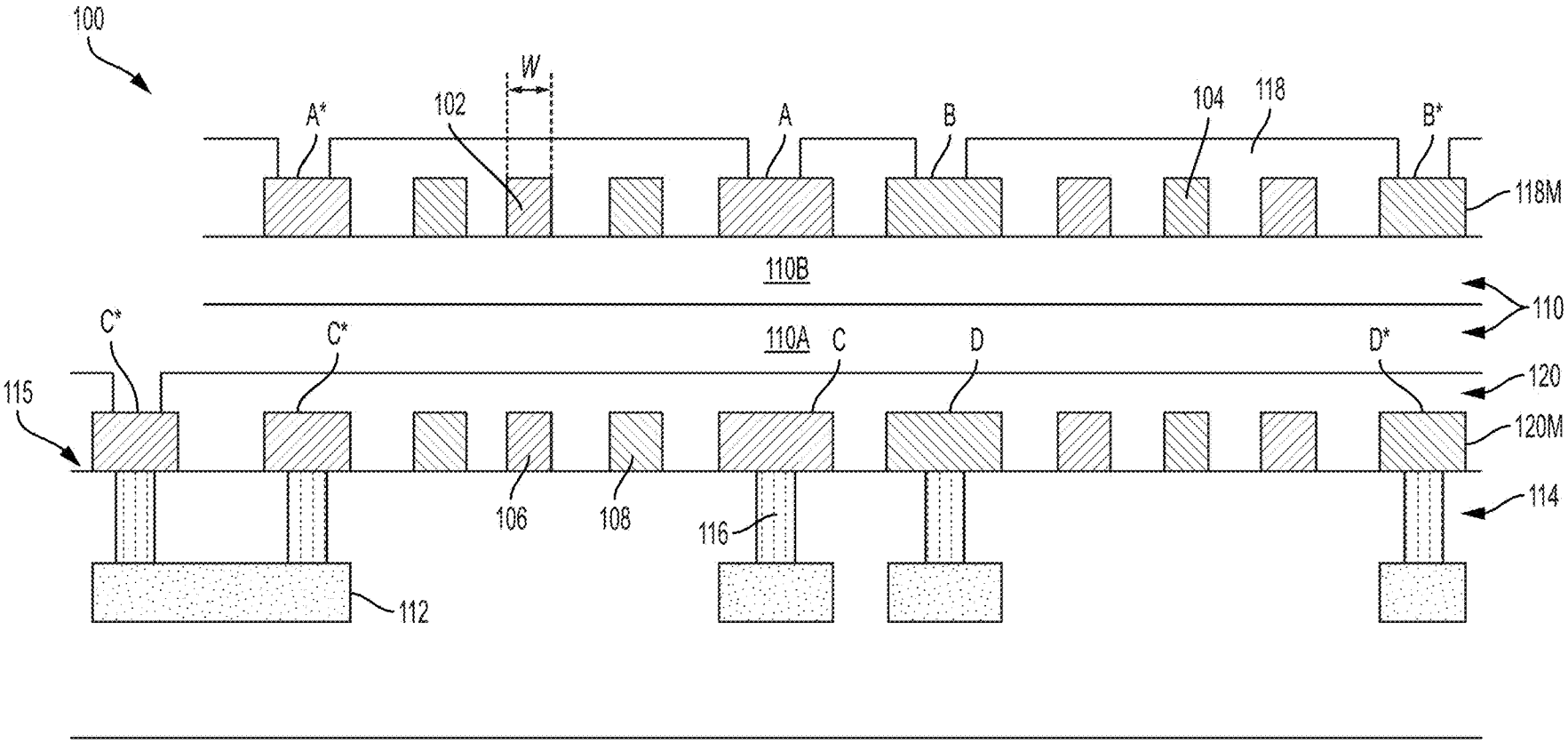
FIG. 1B is a cross-sectional view of the micro-fabricated stacked interleaved coils of FIG. 1A along 1B-1B, according to some non-limiting embodiments.

FIG. 1B illustrates a cross-sectional view of the stacked interleaved coils 100 along line 1B-1B of FIG. 1A. The top pair of interleaved coils may be formed from a metallization layer 118M in an insulating layer 118. The bottom pair of interleaved coils may be formed from a metallization layer 120M in an insulating layer 120. Metallization layers 118M and 120M may be substantially parallel to a surface 115 of the substrate 114. The metallization layer 120M may interconnect to the metallization layer 112 through vias 116. The metallization layers 118M, 120M and 112 may be formed of aluminum, copper, gold, tungsten, or any other suitable conductive material, or any number of conductive materials in any suitable combination. The metallization layers 118M, 120M and 112 may be formed of the same conductive material in some embodiments, or different conductive materials. In some embodiments, the metallization layer 112 may be a copper layer. Traces of the metallization layer 112, for example the center tap 124, may be fabricated by a damascene process. In some embodiments, the metallization layers 118M and 120M may be aluminum layers. In some embodiments, the metallization layer 118M may be gold and layer 120M may be aluminum. The first pair of interleaved coils 101 may be fabricated by etching the aluminum layer 118M to form windings with a width w. The second pair of interleaved coils 103 may be fabricated by etching the aluminum layer 120M with the same width w or a differing width w' with a differing pitch as may be dictated by the process rules, material and design requirements. The width w may be in the range of 1 to 20 μm, for example between 4 to 8 μm, including any value within those ranges. Alternative values are also possible. The two insulating layers 118 and 120 may be separated by the insulating layer 110. The insulating layer 110 may include any suitable structure and material to provide electrical isolation between the stacked pairs of interleaved coils. In some embodiments, the insulating layer may have a multi-layer structure. For example, in the illustrated non-limiting example the insulating layer 110 may include a first layer 110A and a second layer 110B on top of the first layer 110A. The layer 110A may be formed of SiN. The layer 110B may be formed of polyimide. The thickness of the insulating layer 110 may be in the range of 0.25 to 100 microns, for example being between 15 and 30 microns, including any value within those ranges. In embodiments where differing materials are used, one layer may be 0.5 to 2 microns of SiN and other insulating layers may be multiple depositions of 15 to 30 microns of polyimide to complete the second layer.

Figure 1C:
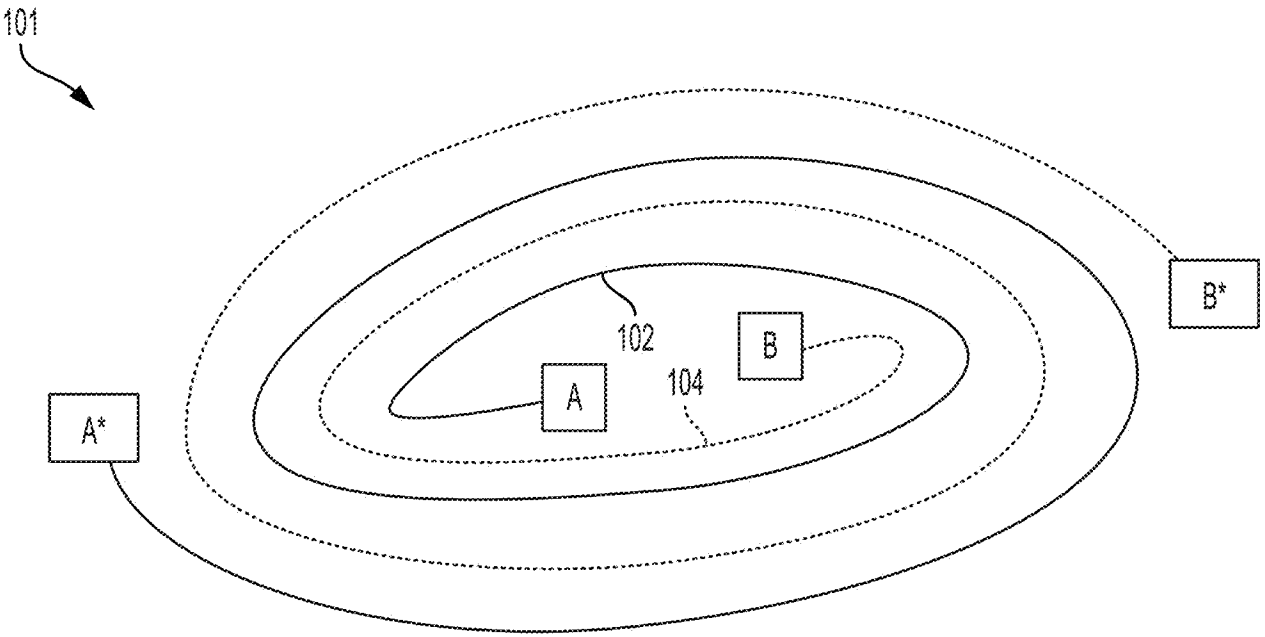
FIG. 1C is a top view of one pair of the micro-fabricated stacked interleaved coils of FIG. 1A, according to some non-limiting embodiments.

FIG. 1C illustrates a top view of the first pair of interleaved coils 101, according to some non-limiting embodiments. Although not visible in the figure, coil 102 may be substantially aligned with coil 106 of the second pair of interleaved coils 103 along a direction substantially perpendicular to the surface 115 of the substrate 114. Likewise, coil 104 may be substantially aligned with coil 108 along the same direction. Therefore, aspects of the present application provide aligned vertically stacked pairs of interleaved coils separated by an insulating layer. In the illustrated example, each of the coils 102 and 104 has 2 turns. However, the present application is not limited in this regard. Each of the coils 102 and 104 may have any number of turns, for example, 2, 3, 3.5, 4, or more. Also, the coil 102 and the coil 104 may have different numbers of turns, for example, 2 turns for coil 102 and 2.5 for coil 104. Other configurations are possible.

In the illustrated example shown in FIG. 1A, the coils 106 and 108 of the second pair of interleaved coils 103 have the same numbers of turns as coils 102 and 104 of the first pair of interleaved coils 101. However, the present application is not limited in this regard. The second pair of interleaved coils may have a number of turns different from that of the first pair of interleaved coils. A ratio of the number of turns of the first pair of interleaved coils to the number of turn of the second pair of interleaved coils may be designed in accordance with intended applications.

Figure 1D:
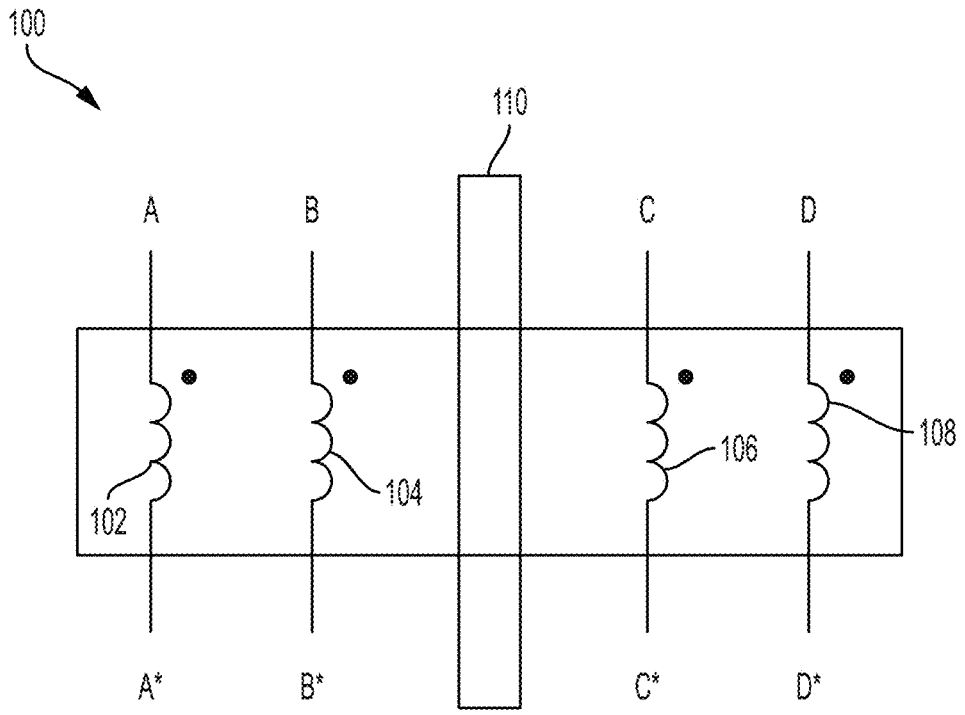
FIG. 1D is an equivalent circuit of the micro-fabricated stacked interleaved coils of FIG. 1A.

FIG. 1D is an equivalent circuit of the stacked interleaved coils 100. Terminals A, B, C, and D are marked with dots, indicating current flow from terminal A to terminal A*, from terminal B to terminal B*, from terminal C to terminal C*, and from terminal D to terminal D*. As a result, mutual inductances can be established in each pair of interleaved coils as well as between top and bottom pairs.

Figure 1E:
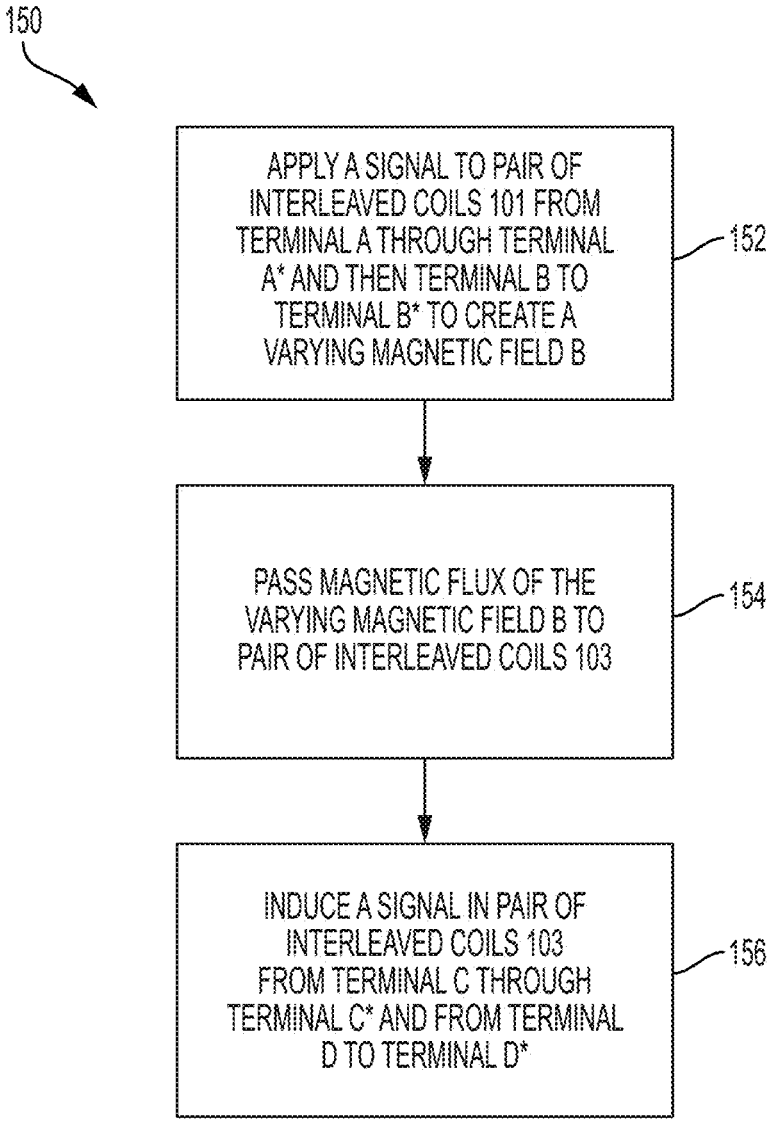
FIG. 1E is a flowchart illustrating an example of the operation of the micro-fabricated stacked interleaved coils of FIGS. 1A and 1B, according to some non-limiting embodiments.

FIG. 1E is a flowchart illustrating an example of the operation of the stacked interleaved coils 100, according to some non-limiting embodiments. The method 150 of operating the stacked interleaved coils 100 may include, at stage 152, applying a signal to the pair of interleaved coils 101 from terminal A through terminal A* and then terminal B to terminal B*. The signal applied may be a time-varying (e.g., alternating current (AC)) signal of any suitable frequency and amplitude. In some situations, the signal may be a data signal, carrying information. As a result of application of the signal to the pair of interleaved coils 101, a varying magnetic field B may be generated at stage 154 of the method. The corresponding magnetic flux may pass through the second pair of interleaved coils 103. Thus, at stage 156, a signal may be induced in the pair of interleaved coils 103 between terminal C through terminal C* and then terminal D to terminal D*. The method 150, however, represents a non-limiting manner of operation of the stacked interleaved coils 100.

Another aspect of the present application provides stacked pairs of micro-fabricated interleaved coils assuming an S-like configuration, which may also be referred to as stacked SS coils. FIG. 2A schematically illustrates a pair of micro-fabricated interleaved coils 201, according to some non-limiting embodiments. The pair of interleaved coils 201 may include a first S coil 202 interleaved with a second S coil 204. The first S coil 202 starting at terminal A may include a clockwise coil portion 202A and a counterclockwise coil portion 202B ending at terminal A*. The second S coil 204 starting at terminal B may include a clockwise coil portion 204A and a counterclockwise coil portion 204B ending at terminal B*. The number of turns may not be the same for the two sides of the S coils, as various alternatives may be implemented in terms of the number of turns. In the illustrated example, 202A and 204B have 2 turns and 202B and 204A have 1.5 turns. However, these are non-limiting examples.

The shape of the SS-coil illustrated in FIG. 2A is non-limiting. In the illustration, the S coils 202 and 204 have a spiral shape. Alternatively, the S coils may have a rectangular shape. Other shapes are also possible while still being an S coil.

Figure 2B:
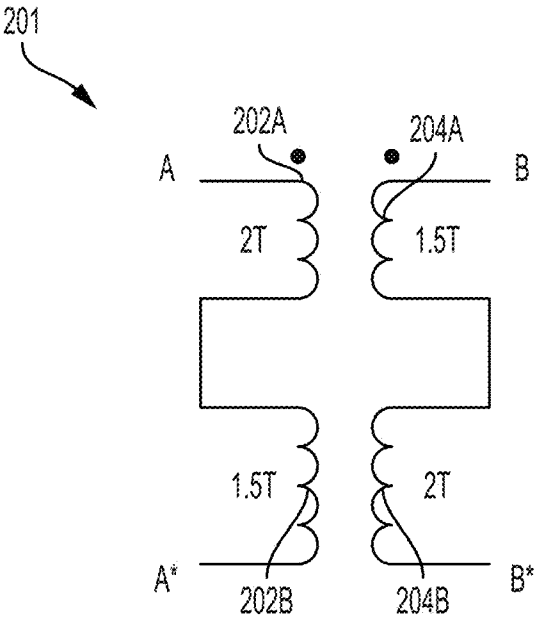
FIG. 2B is an equivalent circuit of the interleaved coils of FIG. 2A.
Figure 2A:
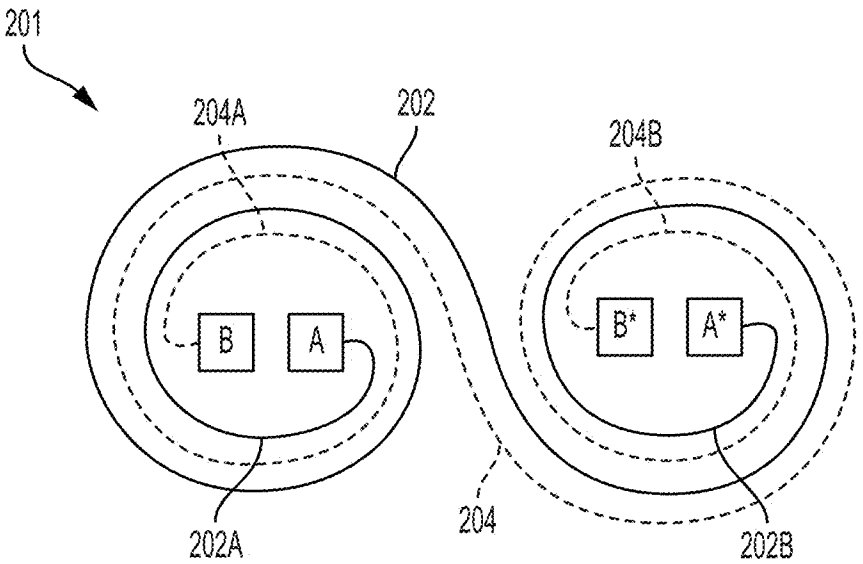
FIG. 2A is a schematic illustrating a pair of micro-fabricated interleaved S coils, according to some non-limiting embodiments.

FIG. 2B is an equivalent circuit of the interleaved SS coil of FIG. 2A. Terminals A and B are marked with dots, indicating currents flow from terminal A to terminal A* and from terminal B to terminal B*. As a result, mutual inductances can be established between coil portions 202A and 204A as well as between coil portions 202B and 204B.

Figure 2D:
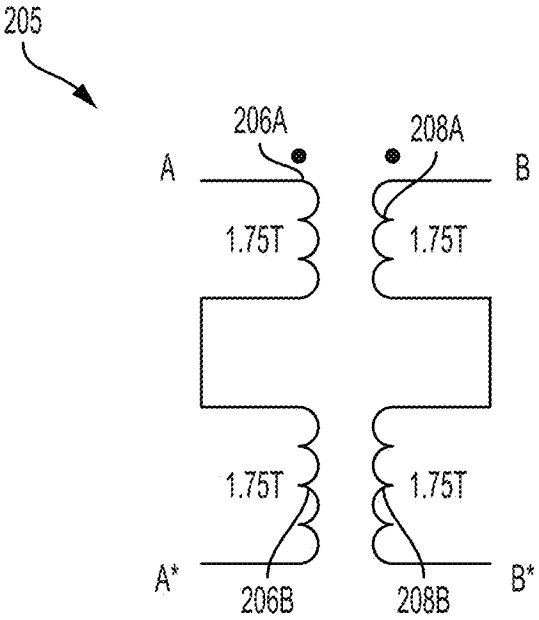
FIG. 2D is an equivalent circuit of the interleaved coils of FIG. 2C.
Figure 2C:
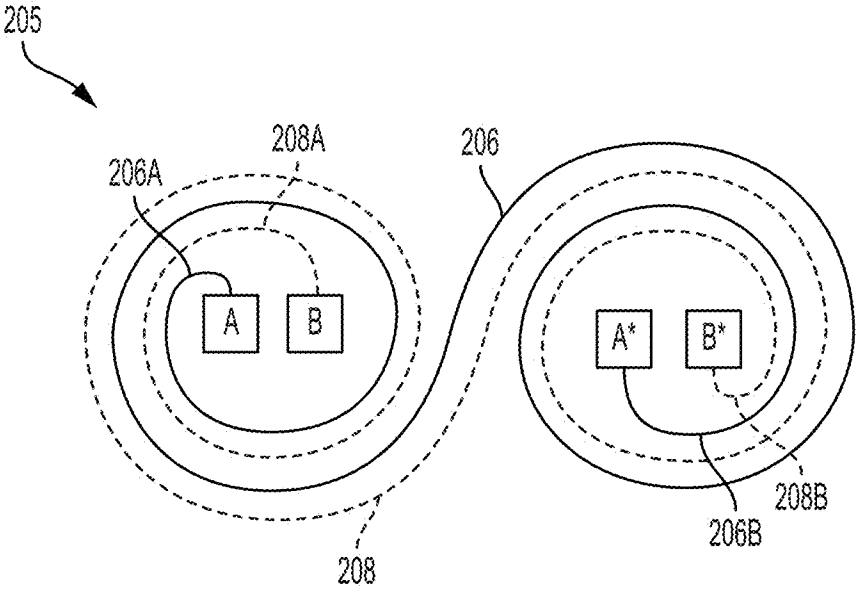
FIG. 2C is a schematic illustrating an alternative layout of a pair of micro-fabricated interleaved S coils, according to some non-limiting embodiments.

FIG. 2C schematically illustrates an alternative layout of an SS coil including a pair of interleaved S coils 205, according to some non-limiting embodiments. FIG. 2D is an equivalent circuit of the SS coil 205. The SS coil 205 may include a first S coil 206 interleaved with a second S coil 208. The first S coil 206 starting at terminal A may include a clockwise coil portion 206A and a counterclockwise coil portion 206B ending at terminal A*. The second S coil 208 starting at terminal B may include a clockwise coil portion 208A and a counterclockwise coil portion 208B ending at terminal B*. The difference between the SS coil 205 and the SS coil 201 of FIG. 2A is that the SS coil 205 has an equal number of turns on each side of the SS coil 205, whereas the SS coil 201 has an unequal number of turns as described above in connection with FIG. 2A. In the non-limiting example of FIG. 2C, the coil portions 206A, 206B, 208A and 208B each have 1.75 turns.

Figure 2G:
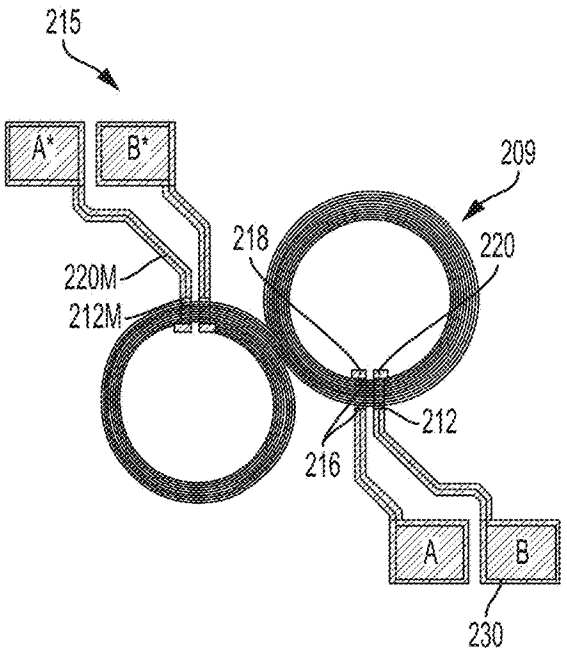
FIG. 2G is a layout view of an alternative layout of interleaved S coils with a bond pad arrangement, according to some non-limiting embodiments.

SS coils of the types described herein may be physically implemented in any suitable manner. As described previously, the coils described herein may be microfabricated, and thus may be formed on a suitable substrate, such as a semiconductor substrate. FIG. 2E is a layout view of an SS coil 211 consistent with the SS coil 201 of FIG. 2A with a suitable bond pad arrangement, according to some non-limiting embodiments. The SS coil 211 may include the SS coil 201, the terminals of which may interconnect through vias 216 to traces 212 and then to bond pads 230. The interleaved S coils 202 and 204 may be formed from a metallization layer 220M as may be bond pads 230. The traces 212 may be formed from a metallization layer 212M on a plane different from but substantially parallel to the plane of the metallization layer 220M. The metallization layers 212M and 220M may be separated by an insulating layer such that the terminals of coils 202 and 204 may be connected to respective bond pads without being electrically short circuited. The metallization layer 220M may be of the type described previously herein with respect to the metallization layer 120M. The metallization layer 212M may be of the type described previously herein with respect to the metallization layer 112. The bond pads for terminals A, A*, B, and B* may be aligned in a line on one side of the SS coil 201.

Figure 2F:
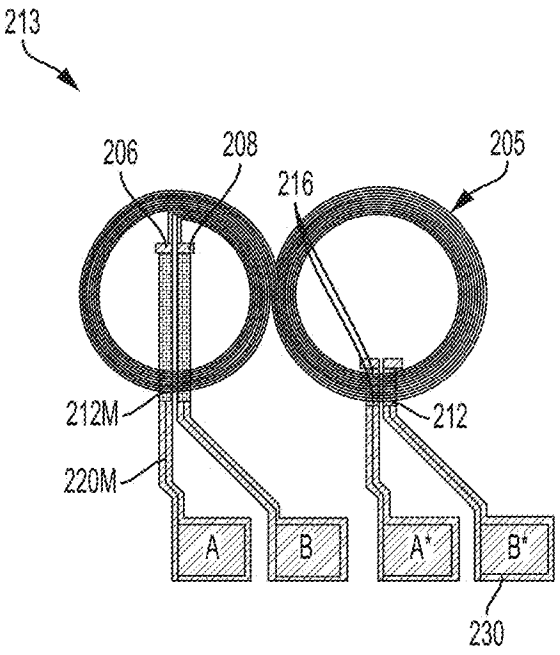
FIG. 2F is a layout view of the interleaved S coils of FIG. 2C with a bond pad arrangement, according to some non-limiting embodiments.
Figure 2E:
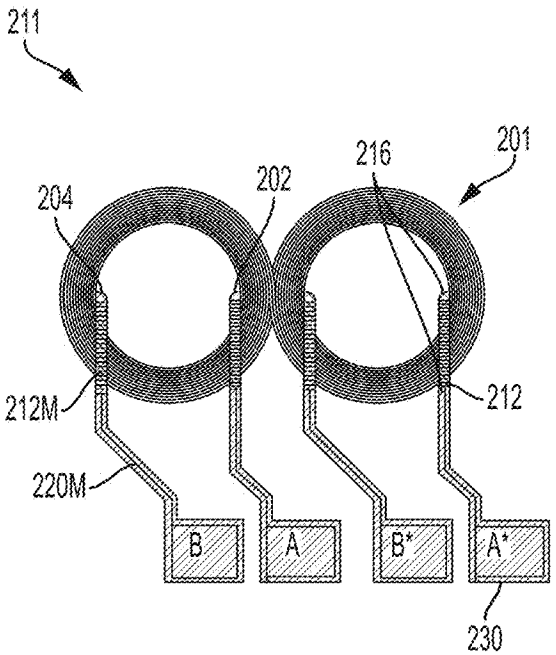
FIG. 2E is a layout view of the interleaved S coils of FIG. 2A with a bond pad arrangement, according to some non-limiting embodiments.

FIG. 2F is a layout view of an SS coil 213 consistent with the SS coil 205 of FIG. 2C with a suitable bond pad arrangement, according to some non-limiting embodiments. The difference between the structure of FIG. 2F and the structure of FIG. 2E is substantially the same as the difference described previously herein between the SS coil 205 of FIG. 2C and the SS coil 201 of FIG. 2A.

FIG. 2G is a layout view of a further alternative of an SS coil 215 with a suitable bond pad arrangement, according to some non-limiting embodiments. The SS coil 215 may include SS coil 209, the terminals of which may interconnect through vias 216 to traces 212 and then to bond pads 230. The SS coil 209 may include a first S coil 218 interleaved with a second S coil 220. The first S coil 218 starting at terminal A may include a clockwise coil portion and a counterclockwise coil portion ending at terminal A*. The second S coil 220 starting at terminal B may include a clockwise coil portion and a counterclockwise coil portion ending at terminal B*. The bond pads for terminals A and B may be aligned in a first line on a first side of the SS coil 209. The bond pads for terminals A* and B* may be aligned in a second line on a second side of the SS coil 209 opposite the first side.

Figure 2I:
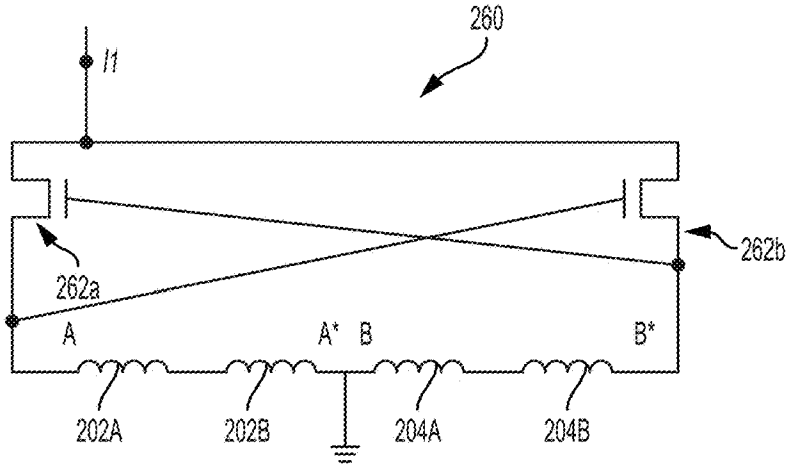
FIG. 2I is a schematic illustrating the interleaved S coils of FIG. 2A driven by P-type transistors, according to some non-limiting embodiments.
Figure 2H:
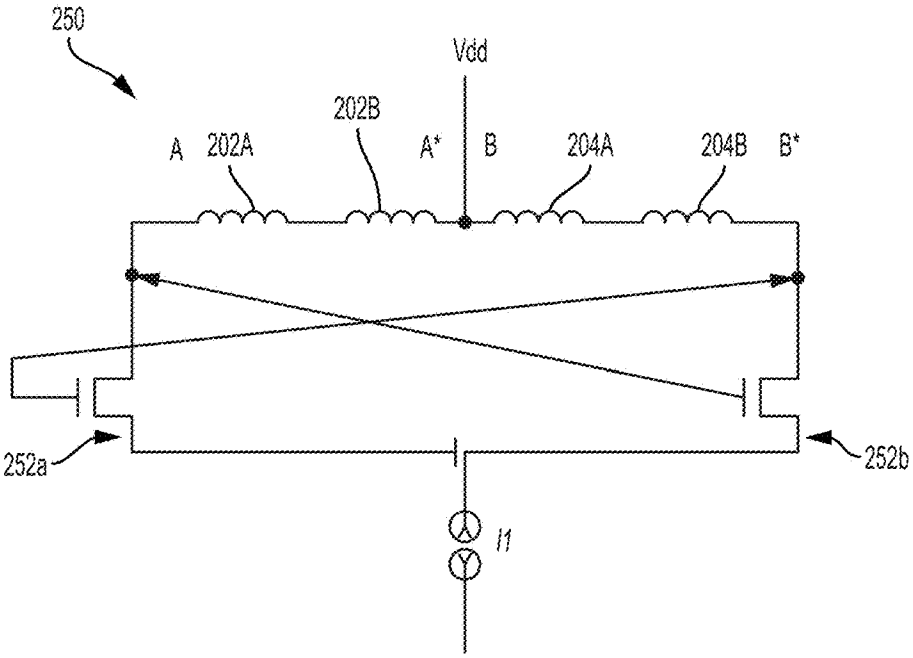
FIG. 2H is a schematic illustrating the interleaved S coils of FIG. 2A driven by N-type transistors, according to some non-limiting embodiments.

FIG. 2H schematically illustrates an example of a circuit 250 in which the SS coil 201 may be implemented. Namely, FIG. 2H illustrates a circuit 250 in which the SS coil 201 is driven by cross-coupled NMOS transistors 252*a* and 252*b*, according to some non-limiting embodiments. The circuit also includes a current source I1. A supply voltage Vdd is applied at the node connecting A* and B.

FIG. 2I schematically illustrates an alternative circuit 260 for driving the SS coil 201. In this non-limiting example, the SS coil 201 is driven by cross-coupled PMOS transistors 262*a* and 262*b*, according to some non-limiting embodiments. A center tap may be formed between terminal A* and terminal B such that coil 202 and coil 204 are connected in series. This node between A* and B may be electrically grounded as shown.

Figure 3A:
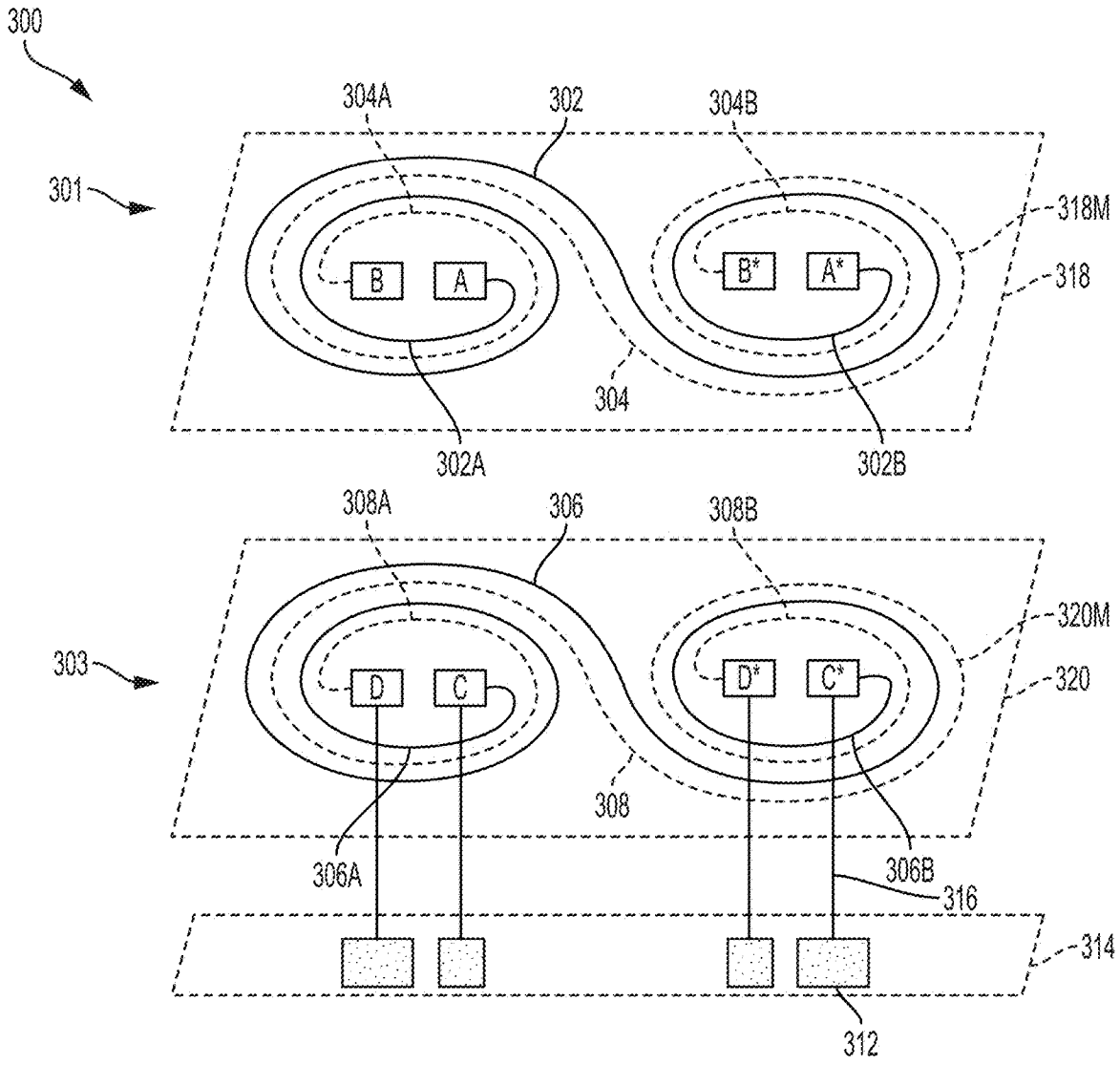
FIG. 3A is a schematic diagram illustrating micro-fabricated stacked interleaved S coils, according to some non-limiting embodiments.

According to some aspects of the present application, two SS coils are stacked relative to each other, and separated by an insulating structure. FIG. 3A illustrates an example, in the form of stacked SS coils 300. The stacked SS coils 300 may include a top SS coil 301 and a bottom SS coil 303 separated by an insulating layer 310 (see FIG. 3B) to provide galvanic isolation. The insulating layer 310 is not shown in FIG. 3A for simplicity of illustration, but may be of the type described previously herein with respect to insulating layer 110. The top SS coil 301 may include a first S coil 302 interleaved with a second S coil 304. S coil 302 starting at terminal A may include a clockwise coil portion 302A and a counterclockwise coil portion 302B ending at terminal A*. S coil 304 starting at terminal B may include a clockwise coil portion 304A and a counterclockwise coil portion 304B ending at terminal B*. The bottom SS coil 303 may include a third S coil 306 interleaved with a fourth S coil 308. S coil 306 starting at terminal C may include a clockwise coil portion 306A and a counterclockwise coil portion 306B ending at terminal C*. S coil 308 starting at terminal D may include a clockwise coil portion 308A and a counterclockwise coil portion 308B ending at terminal D*. The bottom SS coil 303 may be substantially identical to the top SS coil 301 in some embodiments, although alternatives are possible. A ratio of the number of turns of the top SS coil to the number of turns of the bottom SS coil may be designed in accordance with intended applications. For example, the ratio may be in the range of 0.01 to 10, for example, between 0.5 and 5, or between 0.8 and 2.

The stacked SS coils 300 may be formed in, partially in, or on a semiconductor substrate 314. The top SS coil 301 may be formed using a first single metallization layer 318M in an insulating layer 318 of a standard integrated fabrication process. The bottom SS coil 303 may be formed using a second metallization layer 320M in an insulating layer 320 of a standard integrated fabrication process. Metallization layers 318M and 320M may be substantially parallel to a surface of the substrate 314. The insulating layers 318 and 320 may be separated by insulating layer 310, for example of the type described previously in connection with insulating layer 110. The metallization layer 120M may interconnect to a third metallization layer 312 through vias 316.

Figure 3B:
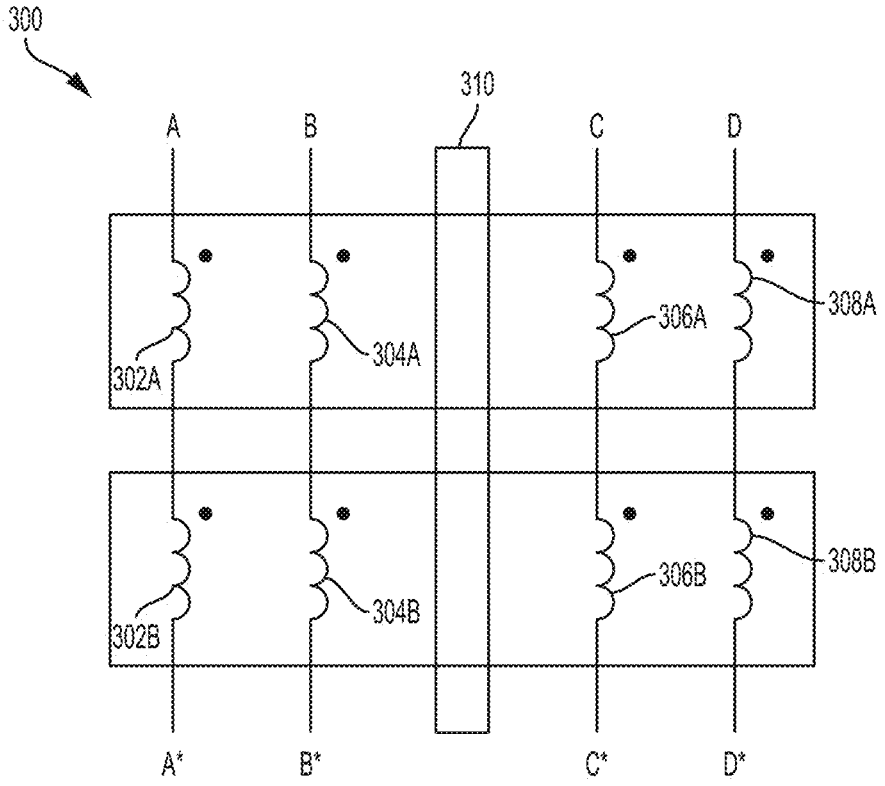
FIG. 3B is an equivalent circuit of the micro-fabricated stacked interleaved S coils of FIG. 3A.

FIG. 3B is an equivalent circuit of the stacked SS coils 300 according to a non-limiting embodiment. Terminals A, B, C, and D are marked with dots, indicating current flow from terminal A to terminal A*, from terminal B to terminal B*, from terminal C to terminal C*, and from terminal D to terminal D*. As a result, mutual inductances can be established between coil portions on the same side of each SS coil as well as between top and bottom SS coils.

Figure 4:
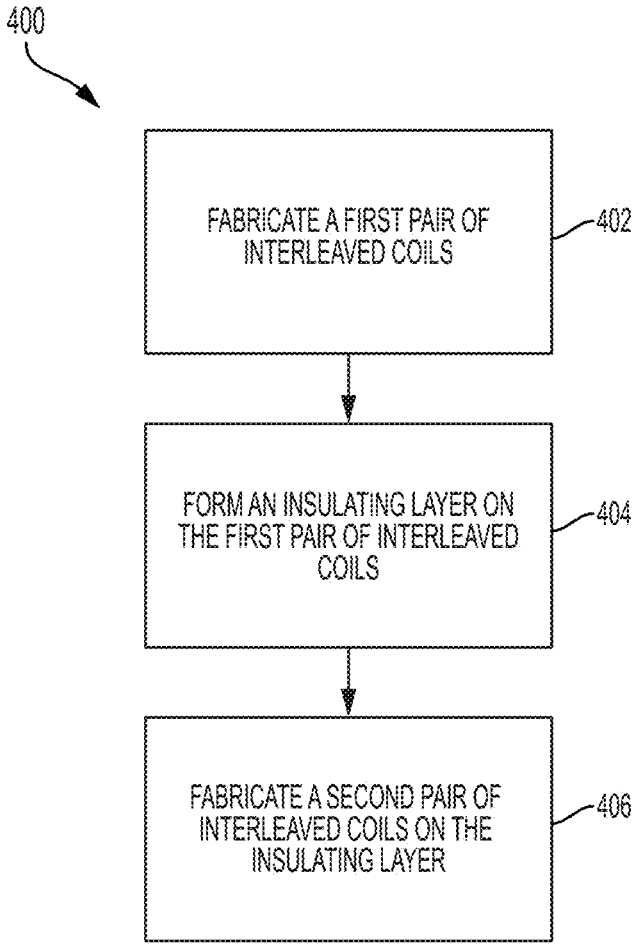
FIG. 4 is a flowchart illustrating a method of manufacturing stacked interleaved coils described herein, according to some non-limiting embodiments.

FIG. 4 illustrates a method of manufacturing micro-fabricated stacked interleaved coils described herein, according to some non-limiting embodiments. Method 400 may begin at stage 402, in which a first pair of interleaved coils may be fabricated. The interleaved coils may be of any of the types described herein, including in at least some embodiments being interleaved S coils. The first pair of interleaved coils may be fabricated in a dielectric layer on a semiconductor substrate in some embodiments.

At stage 404, an insulating layer may be formed on the first pair of interleaved coils. For example, the insulating layer 110 or 310 may be formed. As described previously herein, the insulating layer may have a multi-layer structure in some embodiments and may be formed of any suitable material to provide galvanic isolation.

Proceeding to stage 406, a second pair of interleaved coils may be formed on the insulating layer. The second pair of interleaved coils may be any of the types described herein. In at least some embodiments, stage 406 involves aligning the second pair of interleaved coils with the previously formed first pair of interleaved coils.

Figure 5:
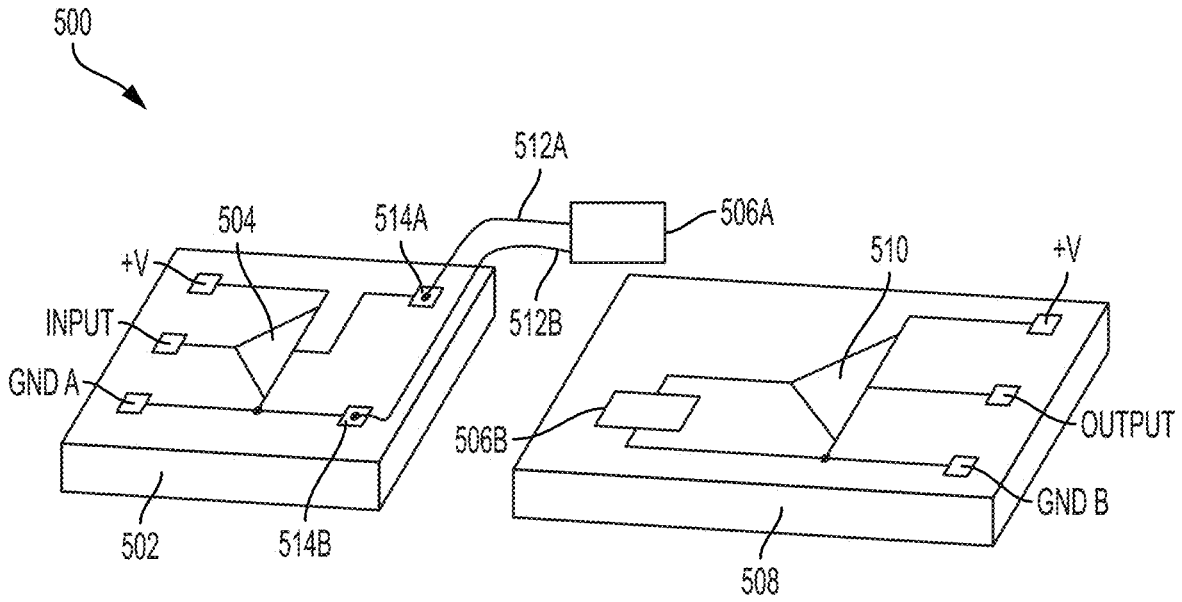
FIG. 5 is a circuit employing micro-fabricated stacked interleaved coils described herein, according to some non-limiting embodiments.

FIG. 5 illustrates a circuit employing micro-fabricated stacked interleaved coils described herein, according to some non-limiting embodiments. The circuit may be an isolator 500 including a transmitter 504 formed on a substrate 502, a transformer formed by micro-fabricated stacked interleaved coils described herein comprising a first pair of interleaved coils 506A and a second pair of interleaved coils 506B formed on a substrate 508, along with a receiver 510. Wire leads 512A and 512B from bond pads 514A and 514B on substrate 502 connect the driver output to the primary winding (first pair of interleaved coils 506A) of the transformer. In the illustrated example, the primary (driving) coil is the first pair of interleaved coils 506A and the secondary (receiving) coil is the second pair of interleaved coils 506B. However, the present application is not limited to this configuration. For example, the primary and secondary coils may be reversed, the transmitter may be on substrate 508, and the receiver may be on substrate 502. In some embodiments, substrates 502 and 508 may be a single substrate. Wire leads 512A and 512B may be formed by metallization layers connected through vias.

Figure 6:
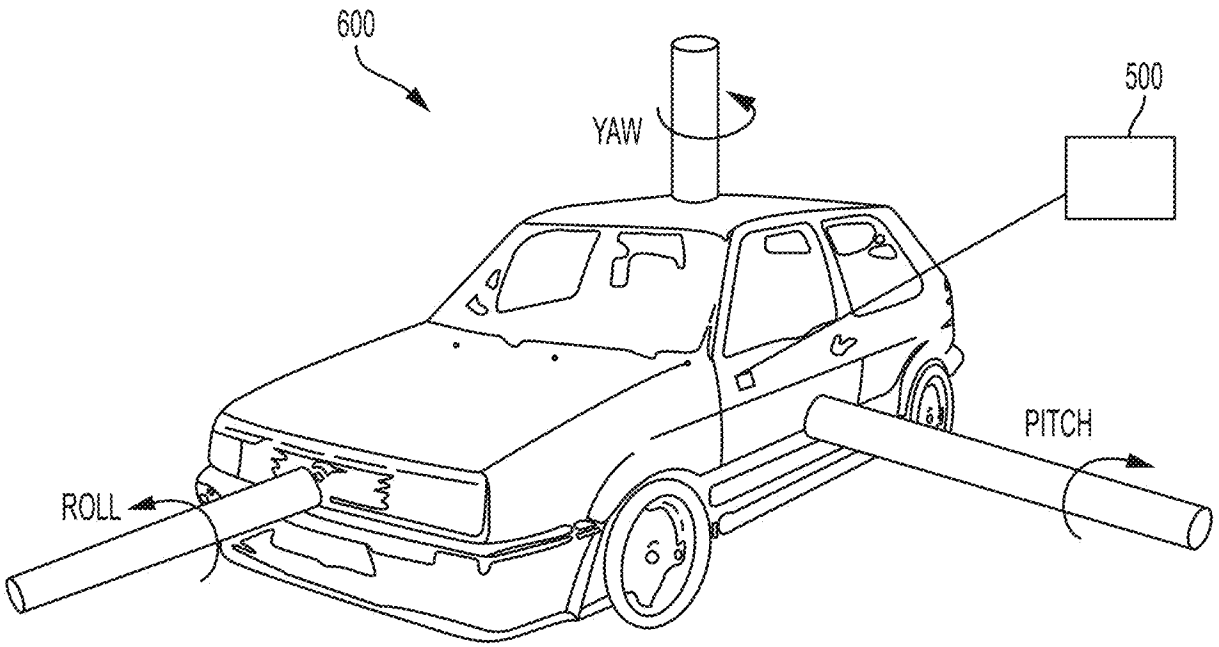
FIG. 6 illustrates a system comprising the circuit of FIG. 5, according to some non-limiting embodiments.

Interleaved coils of the types described herein may be implemented in various settings. As has been described, some aspects of the present application employ interleaved coils in electrical isolators. Electrical isolators in turn may find application in various settings, including in automobiles, or other vehicles, such as boats or aircrafts. FIG. 6 illustrates a system comprising the circuit 500 of FIG. 5, according to some non-limiting embodiments. Circuit 500 may be disposed in any suitable location of car 600. Circuit 500 may be configured to transfer data and/or power signals between circuits of the car 600 that operate in different voltage domains while maintaining galvanic isolation. While FIG. 6 illustrates one example, other uses of the various aspects of the present application are possible.

The terms "approximately", "substantially," and "about" may be used to mean within ±20% of a target value in some embodiments, within ±10% of a target value in some embodiments, within ±5% of a target value in some embodiments, and yet within ±2% of a target value in some embodiments.

What is claimed is:

1. A micro-fabricated coil structure, comprising:

a substrate;

a first pair of interleaved coils on the substrate, the first pair of interleaved coils comprising a first coil wound from a first terminal to a second terminal and a second coil wound from a third terminal to a fourth terminal, the first, second, third, and fourth terminals coupled to first, second, third, and fourth bonding pads respectively, wherein the four respective bonding pads are connected such that current is configured to flow from the first bonding pad to the second bonding pad, from the second bonding pad to the third bonding pad, and from the third bonding pad to the fourth bonding pad;

a second pair of interleaved coils on the substrate, the second pair of interleaved coils being electromagnetically couplable to and galvanically isolated from the first pair of interleaved coils; and an insulating layer separating the first pair of interleaved coils from the second pair of interleaved coils.

2. The micro-fabricated coil structure of claim 1, wherein the four respective bonding pads are connected such that current is configured to flow through the first and second coils in a common rotational direction.

3. The micro-fabricated coil structure of claim 2, wherein the second pair of interleaved coils is substantially aligned with the first pair of interleaved coils along a direction substantially perpendicular to a surface of the substrate on which the first pair of interleaved coils is disposed.

4. The micro-fabricated coil structure of claim 2, wherein the coils of the first pair of interleaved coils represent portions of a first single metallization layer substantially parallel to a surface of the substrate.

5. The micro-fabricated coil structure of claim 4, wherein the coils of the second pair of interleaved coils represent portions of a second single metallization layer substantially parallel to the surface of the substrate.

6. The micro-fabricated coil structure of claim 2, wherein the insulating layer comprises a first layer and a second layer, the first layer being polyimide, the second layer being SiN.

7. The micro-fabricated coil structure of claim 2, comprising: a center tap connecting the second bonding pad and the third bonding pad.

8. The micro-fabricated coil structure of claim 2, wherein the second pair of interleaved coils comprises a first coil wound from a fifth terminal to a sixth terminal and a second coil wound from a seventh terminal to an eighth terminal, the first and second coils of the second pair of interleaved coils are substantially aligned with the first and second coils of the first pair of interleaved coils respectively.

9. The micro-fabricated coil structure of claim 2, wherein the first pair of interleaved coils is a first pair of interleaved S coils and the second pair of interleaved coils is a second pair of interleaved S coils.

10. The micro-fabricated coil structure of claim 9, wherein each pair of the first and second pairs of interleaved S coils comprises first and second S coils, the first and second S coils of the second pair of interleaved S coils are substantially aligned with the first and second coils of the first pair of interleaved coils respectively.

11. The micro-fabricated coil structure of claim 9, wherein the first pair of interleaved S coils comprises coil portions having an unequal number of turns.

12. An isolator, comprising:

a micro-fabricated transformer comprising a primary coil and a secondary coil, wherein the primary coil is a first pair of interleaved coils on a substrate, the first pair of interleaved coils comprises a first coil wound from a first terminal to a second terminal and a second coil wound from a third terminal to a fourth terminal, the first, second, third, and fourth terminals are coupled to first, second, third, and fourth bonding pads respectively, the four respective bonding pads are connected such that current is configured to flow from the first bonding pad to the second bonding pad, from the second bonding pad to the third bonding pad, and from the third bonding pad to the fourth bonding pad, the secondary coil is a second pair of interleaved coils on the substrate, the second pair of interleaved coils is separated from the first pair of interleaved coils by an insulating layer, and the second pair of interleaved coils is electromagnetically couplable to and galvanically isolated from the first pair of interleaved coils;

a transmitter, wherein the transmitter is configured to drive the primary coil; and a receiver, wherein the receiver is configured to receive signals from the secondary coil.

13. The isolator of claim 12, wherein the four respective bonding pads are connected such that current is configured to flow through the first and second coils in a common rotational direction.

14. The isolator of claim 13, wherein the primary coil is separated from the substrate at least by the secondary coil.

15. The isolator of claim 13, wherein the first pair of interleaved coils comprises an SS coil.

16. The isolator of claim 15, wherein the second pair of interleaved coils comprises an SS coil aligned with the SS coil of the primary coil.

17. The isolator of claim 15, wherein the SS coil includes coil portions with an unequal number of turns.

18. The isolator of claim 13, wherein the insulating layer has a multi-layer structure.

19. A micro-fabricated coil structure, comprising:

a substrate;

first and second pairs of interleaved coils on the substrate and separated by an insulator, wherein the first pair of interleaved coils comprises a first coil wound from a first terminal to a second terminal and a second coil wound from a third terminal to a fourth terminal, the first, second, third, and fourth terminals are coupled to first, second, third, and fourth bonding pads respectively, and the four respective bonding pads are connected such that current is configured to flow from the first bonding pad to the second bonding pad, from the second bonding pad to the third bonding pad, and from the third bonding pad to the fourth bonding pad.

20. The micro-fabricated coil structure of claim 19, wherein the four respective bonding pads are connected such that current is configured to flow through the first and second coils in a common rotational direction.

21. The micro-fabricated coil structure of claim 20, wherein the second pair of interleaved coils is substantially aligned with the first pair of interleaved coils along a direction substantially perpendicular to a surface of the substrate on which the first pair of interleaved coils is disposed.

22. The micro-fabricated coil structure of claim 20, wherein the coils of the first pair of interleaved coils represent portions of a first single metallization layer substantially parallel to a surface of the substrate.

23. The micro-fabricated coil structure of claim 22, wherein the coils of the second pair of interleaved coils represent portions of a second single metallization layer substantially parallel to the surface of the substrate.

* * * * *